US010965020B2

(12) United States Patent
Nakamura

(10) Patent No.: US 10,965,020 B2
(45) Date of Patent: Mar. 30, 2021

(54) ANTENNA DEVICE

(71) Applicant: SOCIONEXT INC., Kanagawa (JP)

(72) Inventor: Maki Nakamura, Yokohama (JP)

(73) Assignee: SOCIONEXT INC., Kanagawa (JP)

( * ) Notice: Subject to any disclaimer, the term of this patent is extended or adjusted under 35 U.S.C. 154(b) by 0 days.

(21) Appl. No.: 16/694,250

(22) Filed: Nov. 25, 2019

(65) Prior Publication Data

US 2020/0091599 A1 Mar. 19, 2020

Related U.S. Application Data

(63) Continuation of application No. PCT/JP2018/021559, filed on Jun. 5, 2018.

(30) Foreign Application Priority Data

Jun. 23, 2017 (JP) ..... JP2017-123260

(51) Int. Cl.
*H01Q 1/52* (2006.01)
*H01Q 1/22* (2006.01)
*H01Q 1/38* (2006.01)

(52) U.S. Cl.
CPC ..... *H01Q 1/52* (2013.01); *H01Q 1/2283* (2013.01); *H01Q 1/38* (2013.01)

(58) Field of Classification Search
CPC ..... H01Q 1/52; H01Q 1/2283; H01Q 1/38
See application file for complete search history.

(56) References Cited

U.S. PATENT DOCUMENTS

| | | | | |
|---|---|---|---|---|
| 2009/0153433 | A1 | 6/2009 | Nagai et al. | |
| 2015/0194728 | A1 | 7/2015 | Piau et al. | |
| 2016/0141749 | A1 | 5/2016 | Tagi et al. | |
| 2016/0344093 | A1 | 11/2016 | Tagi et al. | |
| 2018/0277946 | A1* | 9/2018 | Murata | H01Q 9/0407 |
| 2020/0328531 | A1* | 10/2020 | Onaka | H01Q 1/38 |

FOREIGN PATENT DOCUMENTS

| | | | |
|---|---|---|---|
| JP | 2005-094440 | A | 4/2005 |
| JP | 2007-166115 | A | 6/2007 |
| JP | 2016-105584 | A | 6/2016 |
| JP | 2016-220029 | A | 12/2016 |

OTHER PUBLICATIONS

International Search Report dated Aug. 14, 2018, in International Patent Application No. PCT/JP2018/021559; with English translation.

* cited by examiner

*Primary Examiner* — Daniel D Chang
(74) *Attorney, Agent, or Firm* — McDermott Will & Emery LLP

(57) ABSTRACT

In an antenna device, an isolation structure between antenna elements includes: a conductor on a surface of a dielectric substrate; and a plurality of via conductors that penetrate the dielectric substrate and electrically connect the conductor to the ground conductor. A value of $(d1\times2+h1)/(\lambda1/\sqrt{\varepsilon_r})$ falls within a range from 0.40 to 0.60, where the dielectric substrate has a dielectric constant $\varepsilon_r$, a signal transmitted from the antenna element has a wavelength λ1 (mm), each via conductor has a height h1 (mm), and the conductor protrudes with a length d1 (mm) toward the antenna element.

6 Claims, 10 Drawing Sheets

20 GHz

60 GHz

80 GHz

20 GHz

60 GHz

80 GHz

20 GHz

60 GHz

80 GHz

CONFIGURATION SHOWN IN FIG. 3
60 GHz

CONFIGURATION SHOWN IN FIG. 5
60 GHz

ANTENNA DEVICE

CROSS-REFERENCE TO RELATED APPLICATIONS

This is a continuation of International Application No. PCT/JP2018/021559 filed on Jun. 5, 2018, which claims priority to Japanese Patent Application No. 2017-123260 filed on Jun. 23, 2017. The entire disclosures of these applications are incorporated by reference herein.

BACKGROUND

The present disclosure relates to an antenna device with an isolation structure for improving isolation between antenna elements.

Japanese Unexamined Patent Publication No. 2016-105584 discloses a configuration to improve isolation between antenna elements without increasing the overall size of an antenna device with an electromagnetic band gap (EBG) structure. This EBG structure includes: a first patch conductor on the surface of a dielectric substrate provided with an antenna; a second patch conductor above the first patch conductor; and a plurality of via conductors electrically connecting the first patch conductor to the second patch conductor.

FIG. 10 is an explanatory diagram of isolation between antennas. In the configuration of FIG. 10, a transmitting antenna TX and a receiving antenna RX are arranged on a surface of a dielectric substrate 100. In this configuration, isolation corresponds to a passing loss from the transmitting antenna TX to the receiving antenna RX. As indicated by the broken lines in FIG. 10, factors hindering this isolation may be: (1) direct waves propagating through the air, (2) direct waves propagating through a dielectric, (3) reflected waves propagating through the dielectric, and (4) radiation waves obtained by exciting a current at a GND plane 101 by radiation from the transmitting antenna TX and radiating the excited current at an end of the GND plane 101.

The area with the EBG structure according to Japanese Unexamined Patent Publication No. 2016-105584 has high impedance with respect to the current flowing through the GND plane. This document addresses thus (4) the radiation at the end of the GND plane 101 in FIG. 10, but fails to sufficiently address the other factors.

The present disclosure is intended to provide an antenna device with an isolation structure capable of effectively improving isolation.

SUMMARY

An antenna device according to one aspect of the present disclosure includes: a first dielectric substrate having a first surface and a second surface; a first antenna element and a second antenna element on the first surface of the first dielectric substrate; a ground conductor on the second surface of the first dielectric substrate; and an isolation structure between the first and second antenna elements. The isolation structure further includes: a first conductor between the first and second antenna elements on the first surface of the first dielectric substrate; and a plurality of first via conductors that penetrate the first dielectric substrate and electrically connect the first conductor to the ground conductor. The first dielectric substrate has a dielectric constant of $\varepsilon_r$. The first antenna element is a transmitting antenna for transmitting a signal with a wavelength $\lambda 1$ (mm). In a plan view, the plurality of first via conductors are arranged at a predetermined pitch in a second direction perpendicular to a first direction in which the first and second antenna elements are arranged, and each of the first via conductors has a height h1 (mm). The first conductor protrudes with a length d1 (mm) from centers of the first via conductors toward the first antenna element in the first direction. A value of $(d1\times 2+h1)/(\lambda 1/\sqrt{\varepsilon_r})$ falls within a range from 0.40 to 0.60.

According to this aspect, the effect of improving isolation with the isolation structure increases.

The present disclosure provides an antenna device with an isolation structure capable of effectively improving isolation.

DETAILED DESCRIPTION

Now, embodiments will be described in detail with reference to the drawings.

Figure 1:
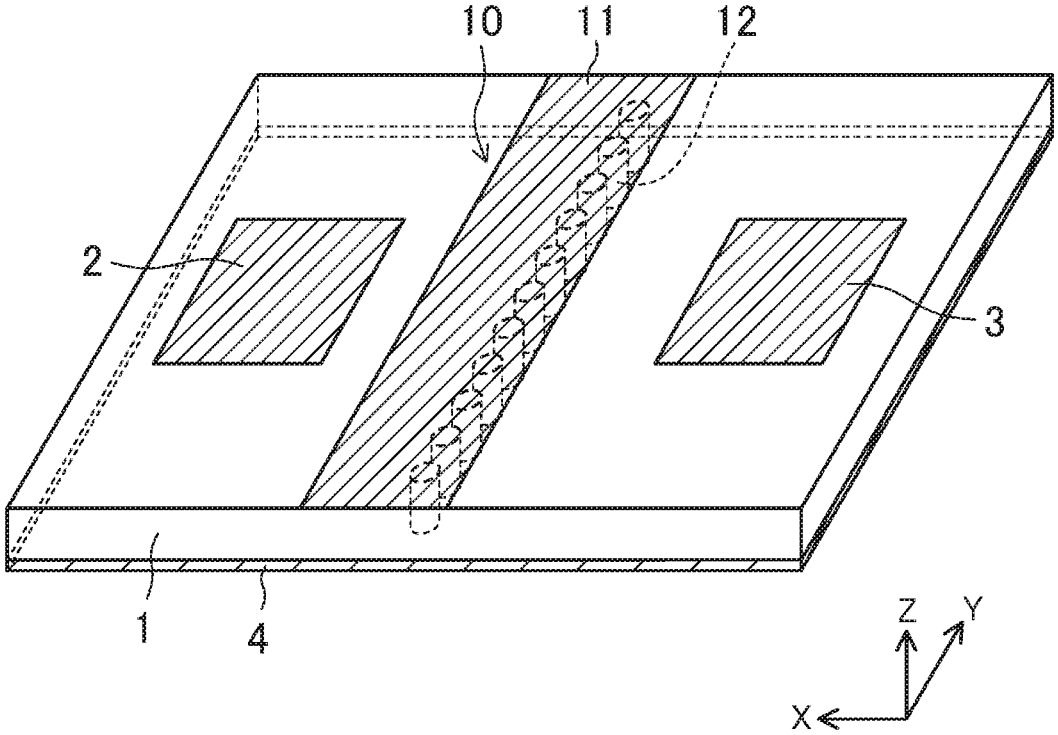
FIG. 1 is a perspective view showing a configuration of an antenna device according to an embodiment.
Figure 2:
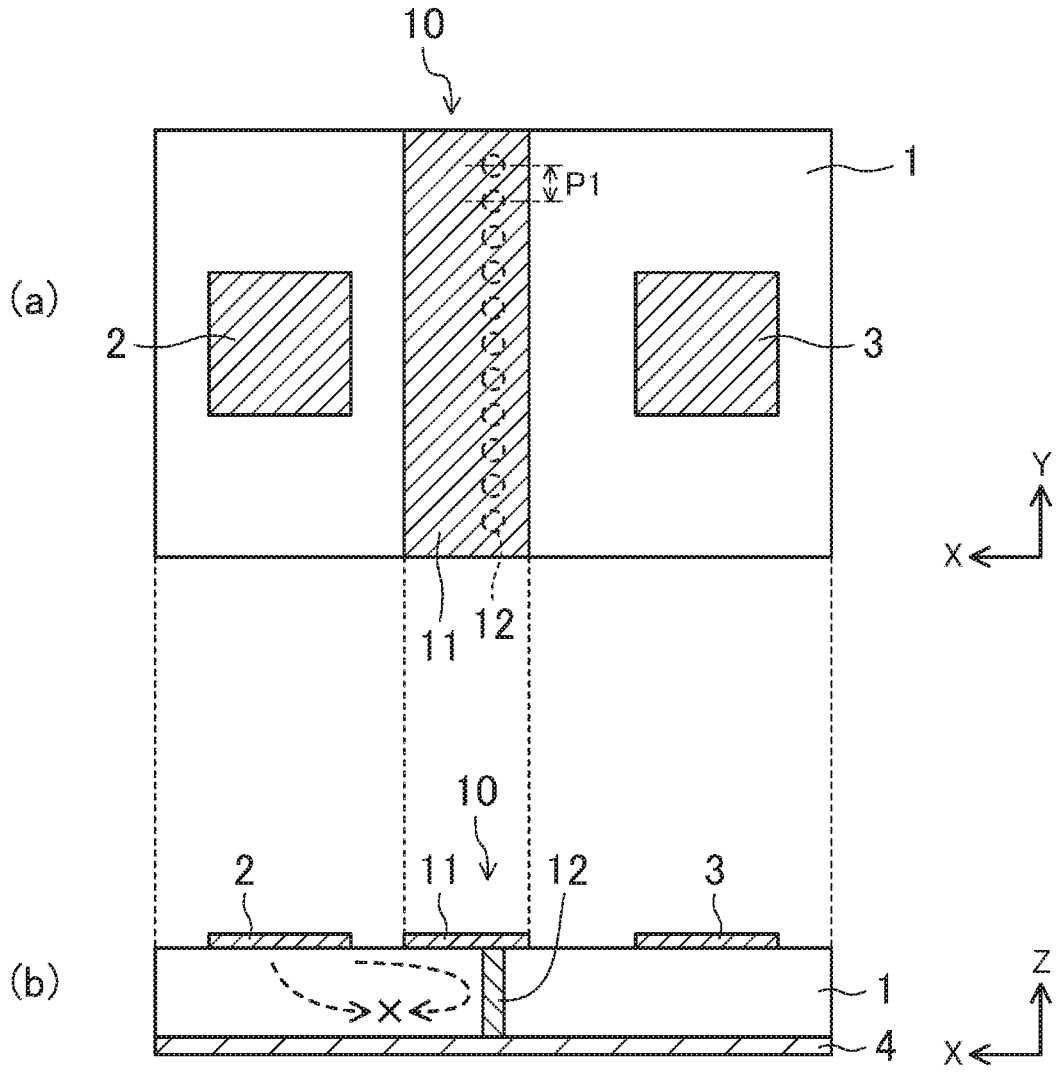
FIG. 2 shows the antenna device of FIG. 1; that is, an illustration (a) is a plan view, whereas an illustration (b) is a cross-sectional view.

FIG. 1 is a perspective view showing a schematic configuration of an antenna device according to an embodiment. FIG. 2 shows the antenna device of FIG. 1; that is, an illustration (a) is a plan view, whereas an illustration (b) is a cross-sectional view.

The antenna device shown in FIGS. 1 and 2 includes a dielectric substrate 1, first and second antenna elements 2 and 3, a ground conductor 4, and an isolation structure 10. The first and second antenna elements 2 and 3 are arranged on the upper surface, which corresponds to a first surface, of the dielectric substrate 1. The ground conductor 4 is disposed on the lower surface, which corresponds to a second surface, of the dielectric substrate 1. The isolation structure 10 is interposed between the first and second antenna elements 2 and 3. Here, the first antenna element 2 is a transmitting antenna, whereas the second antenna element 3 is a receiving antenna. The isolation structure 10 includes a conductor 11 and a plurality of via conductors 12. The conductor 11 is interposed between the first and second antenna elements 2 and 3 on the upper surface of the dielectric substrate 1. The via conductors 12 penetrate the dielectric substrate 1 and electrically connect the conductor 11 to the ground conductor 4.

In FIG. 1, the direction in which the first and second antenna elements 2 and 3 are arranged is defined as an X direction, which corresponds to a first direction. The direction perpendicular to the X direction in a plan view is defined as a Y direction, which corresponds to a second direction. The direction perpendicular to the substrate surface is defined as a Z direction. The illustration (b) of FIG. 2 shows a cross-section of the first and second antenna elements 2 and 3 and the via conductors 12 along the X direction. The conductor 11 has a strip-like planar shape extending in the Y direction. The via conductors 12 have here cylindrical shapes, and are arranged at a predetermined pitch P1 in the Y direction in the plan view. Further, the antenna elements 2 and 3 have substantially square planar shapes. The planar shapes of the antenna elements 2 and 3 are however not limited thereto.

The isolation structure 10 functions to improve isolation of the antenna device. That is, against radio wave signals propagating through the dielectric substrate 1, the conductor 11 serves as an electrical roof whereas the plurality of via conductors 12 serve as electrical walls. In the illustration (b) of FIG. 2, the broken lines represent radio signals output from the first antenna element 2 in the dielectric substrate 1. If a phase shift is observed by half the wavelength between the signal component reflected by the inner wall of the isolation structure 10 and the signal component to enter or to be diffracted by the isolation structure 10, the signal components cancel each other. This is assumed to improve the isolation of the antenna device.

Figure 3:
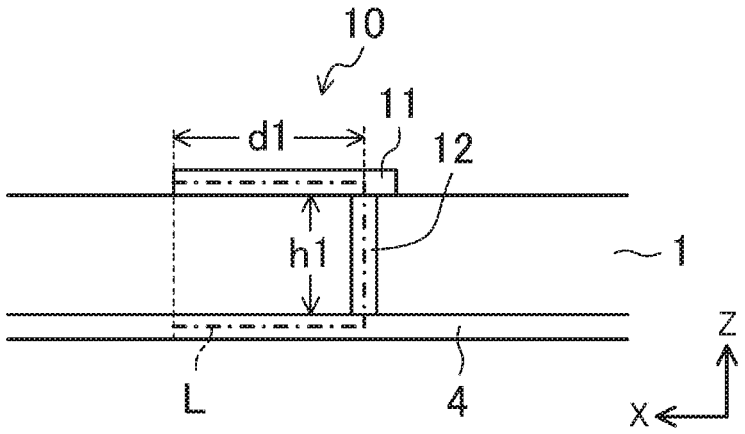
FIG. 3 is a cross-sectional view showing a configuration example of an isolation structure.

FIG. 3 is a cross-sectional view showing a configuration example of an isolation structure according to this embodiment. As shown in FIG. 3, the conductor 11 protrudes with a length d1 (mm) from the centers of the via conductors 12 toward the first antenna element 2 in the X direction. Each via conductor 12 has a height h1 (mm). The first antenna element 2 transmits a signal with a wavelength λ1 (mm). The dielectric substrate 1 has a dielectric constant of $\varepsilon_r$. The wavelength (effective wavelength) $\lambda_\varepsilon$ of a signal propagating through the dielectric substrate 1 is $\lambda 1/\sqrt{\varepsilon_r}$.

As a result of studies, the present inventor has found the following. Specifically, in this case, $L=d1\times 2+h1$, where the dash-dot line in FIG. 3 has a length L. If the value obtained by normalizing the length L by the effective wavelength $\lambda_\varepsilon$, that is $L/\lambda_\varepsilon=(d1\times 2+h1)/(\sqrt{\varepsilon_r})$ falls within a range from 0.40 to 0.60, a significant effect in improvement of isolation is observed.

The present inventor used the following simulation model. The antenna sizes of the first and second antenna elements 2 and 3 were optimized by the transmission frequency and dielectric constant of the dielectric substrate 1. The distance between the centers of the first and second antenna elements 2 and 3 corresponded to the wavelength λ1 of a transmission signal; whereas the thickness of the dielectric substrate 1 was 0.05 times the wavelength λ1 of the transmission signal. Simulations were performed with three transmission frequencies of 20 GHz, 60 GHz, and 80 GHz. Since the dielectric constant $\varepsilon_r$ of the dielectric substrate 1 generally falls within a range from 2.0 to 5.0, the dielectric constant $\varepsilon_r$ was 3.0.

Figure 4A:
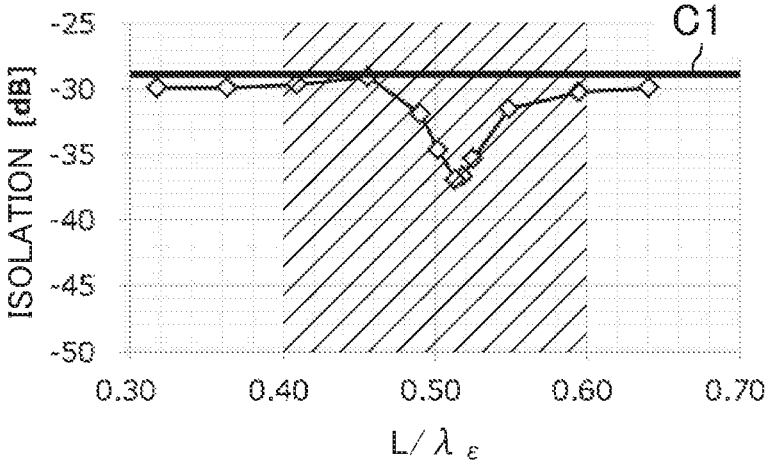
FIGS. 4A to 4C show graphs showing results of simulations using the configuration in FIG. 3.
Figure 4B:
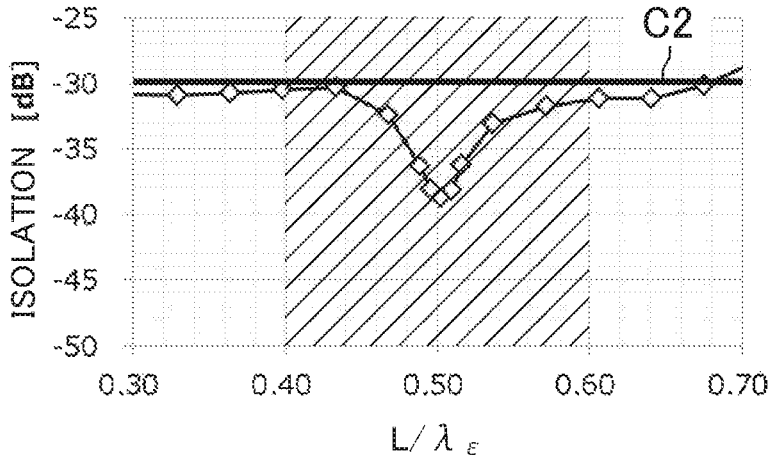
Figure 4C:
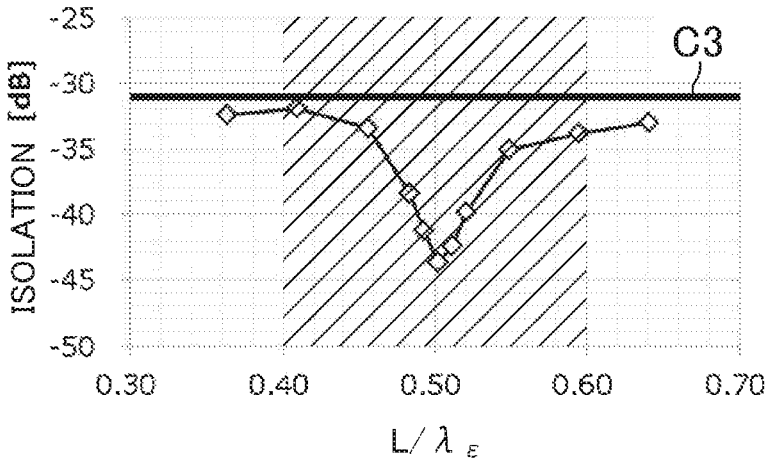

FIGS. 4A to 4C provide graphs showing simulation results; that is, FIGS. 4A to 4C respectively show the cases where the transmission frequencies are 20 GHz, 60 GHz, and 80 GHz. In each graph, the horizontal axis represents the value $L/\lambda_\varepsilon$ described above, and the vertical axis represents isolation (dB). The straight horizontal lines C1 to C3 indicate the isolation values where the isolation structure 10 is not provided.

As can be seen from FIGS. 4A to 4C, the isolation marks the peak around the value $L/\lambda_\varepsilon$ of 0.50 in each of the transmission frequencies 20 GHz, 60 GHz, and 80 GHz. That is, if the length L is approximately ½ of the effective wavelength $\lambda_\varepsilon$ of the transmission signal, the isolation improves most. This result is consistent with the assumption described above. If the value $L/\lambda_\varepsilon$ falls within the range from 0.40 to 0.60, the isolation improves greatly. If the value $L/\lambda_\varepsilon$ falls within the range from 0.45 to 0.55, the isolation improves more. When the simulations were performed where the dielectric substrate 1 had a dielectric constant $\varepsilon_r$ of 2.0 or 5.0, the same characteristics as in FIGS. 4A to 4C were obtained.

From the simulation results shown in FIGS. 4A to 4C, if the value $L/\lambda_\varepsilon$ falls within the range from 0.40 to 0.60, the isolation structure 10 of FIG. 3 exhibits a large improvement effect of the isolation. This effect of improving the isolation is considered to be obtained where transmission frequency falls within a range at least from 10 GHz to 100 GHz.

Alternative Configuration Example 1

Figure 5:
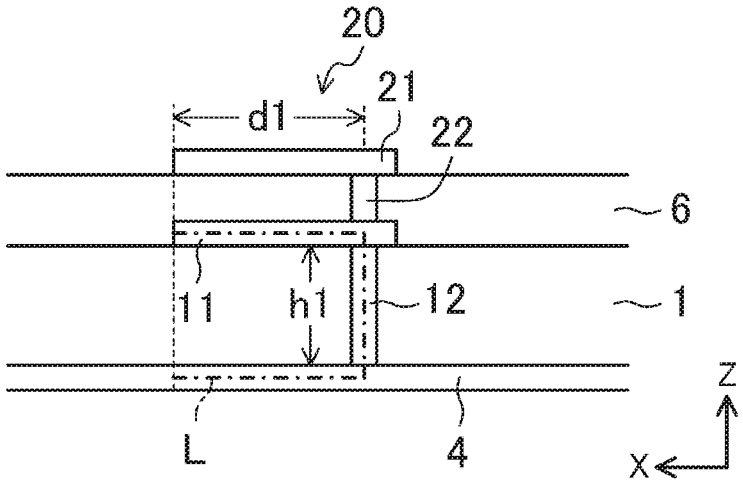
FIG. 5 is a cross-sectional view showing another configuration example of the isolation structure.

FIG. 5 shows another configuration example of the isolation structure. In the structure shown in FIG. 5, a dielectric substrate 6 as a second dielectric substrate is disposed on the dielectric substrate 1 as a first dielectric substrate. The lower surface, which corresponds to the second surface, of the dielectric substrate 6 is in contact with the upper surface of the dielectric substrate 1. An isolation structure 20 includes, in addition to the conductor 11 as a first conductor and the via conductors 12 as first via conductors, a conductor 21 as a second conductor, and a plurality of via conductors 22 as second via conductors. The conductor 21 is disposed on the upper surface, which corresponds to a first surface, of the dielectric substrate 6. The via conductors 22 penetrate the dielectric substrate 6 and electrically connect the conductor 21 to the conductor 11. Although not shown in the figure, the conductor 21 has a strip-like planar shape extending in the Y direction like the conductor 11. Like the via conductors 12, the via conductors 22 have cylindrical shapes, and are arranged at a predetermined pitch P1 in the Y direction. In addition, the via conductors 22 are arranged in the same positions as the via conductors 12 in the X direction.

The present inventor performed simulations using the configuration of FIG. 5 as well. In this simulation, from the centers of the via conductors 12 toward the first antenna element 2 in the X direction, the protrusion of the conductor 21 had the same length d1 (mm) as that of the conductor 11. Other conditions were the same as in the simulations described above.

Figure 6A:
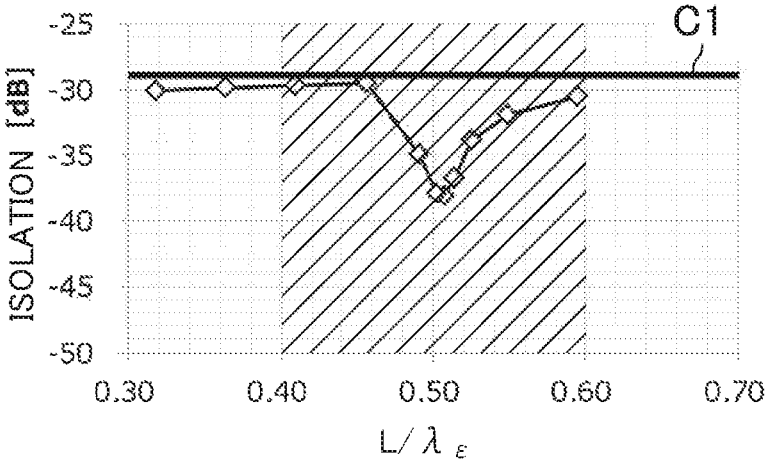
FIGS. 6A to 6C show graphs showing results of simulations using the configuration shown in FIG. 5.
Figure 6B:
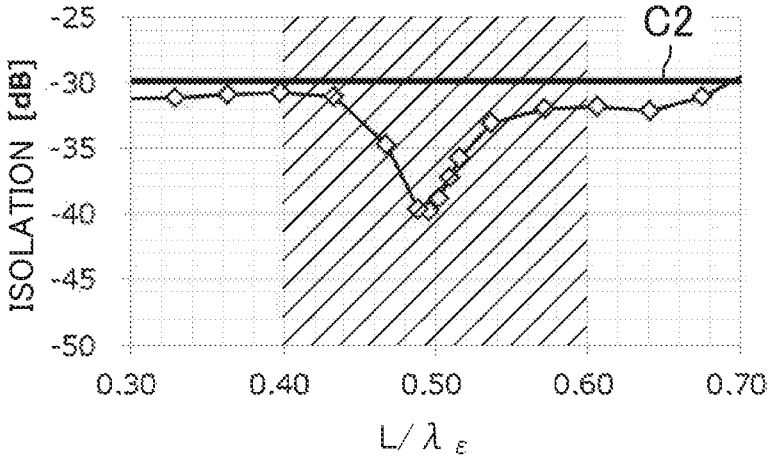
Figure 6C:
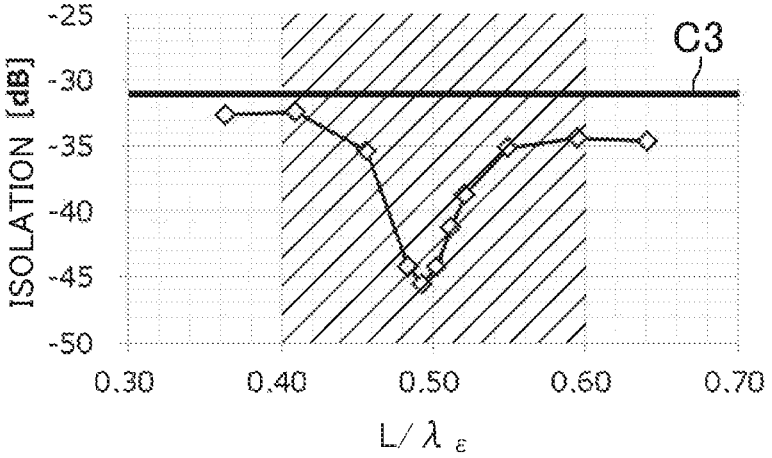

FIGS. 6A to 6C provide graphs showing simulation results that is, FIGS. 6A to 6C respectively show the cases where the transmission frequencies are 20 GHz, 60 GHz, and 80 GHz. In each graph, the horizontal axis represents the value $L/\lambda_\varepsilon$ described above, and the vertical axis represents isolation (dB). The straight horizontal lines C1 to C3 indicate the isolation values where the isolation structure 20 is not provided.

As can be seen from FIGS. 6A to 6C, simulation results similar to those in the graphs of FIGS. 4A to 4C were obtained. Specifically, the isolation marks the peak around the value $L/\lambda_\varepsilon$ of 0.50 in each of the transmission frequencies 20 GHz, 60 GHz, and 80 GHz. If the value $L/\lambda_\varepsilon$ falls within the range from 0.40 to 0.60, the isolation improves greatly. If the value $L/\lambda_\varepsilon$ falls within the range from 0.45 to 0.55, the isolation improves more. When the simulations were performed where the dielectric substrate 1 had a dielectric constant $\varepsilon_r$ of 2.0 or 5.0, the same characteristics as those shown in FIGS. 6A to 6C were obtained.

From the simulation results shown in FIGS. 6A to 6C, if the value $L/\lambda_\varepsilon$ falls within the range from 0.40 to 0.60, the isolation structure 20 of FIG. 5 exhibits a large effect of improving the isolation. This effect of improving the isolation is considered to be obtained where transmission frequency falls within a range at least from 10 GHz to 100 GHz.

Alternative Configuration Example 2

Figure 7:
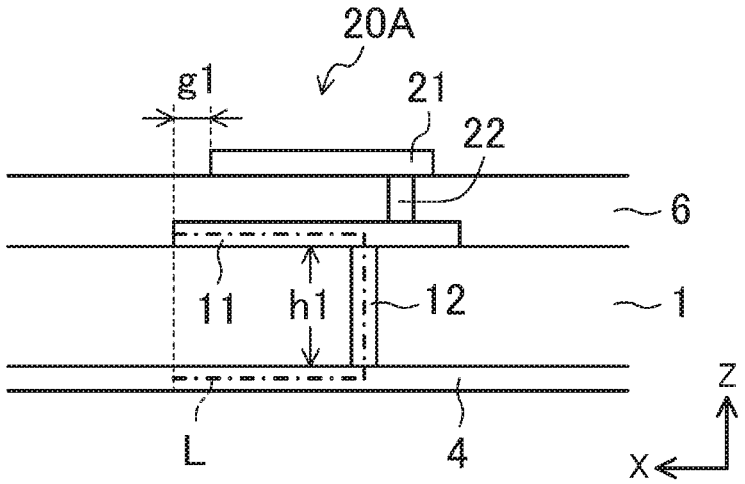
FIG. 7 is a cross-sectional view showing still another configuration example of the isolation structure.

FIG. 7 shows further another configuration example of the isolation structure. An isolation structure 20A of FIG. 7 has substantially the same configuration as that of the isolation structure 20 of FIG. 5. In the isolation structure 20A, however, the via conductors 22 are arranged in different positions from the via conductors 12 in the X direction. This is because it may be advantageous that the arrangement positions of the via conductors 12 and the via conductors 22 are shifted by a predetermined interval or more in the plan view in manufacturing the antenna device.

In the configuration shown in FIG. 7, from the centers of the via conductors 12 toward the first antenna element 2 in the X direction, the protrusion of the conductor 21 is shorter than that of the conductor 11.

The present inventor performed simulations on the relationship between g1 (mm) and the effect of improving the isolation using the configuration shown in FIG. 7, where g1 was the difference between the end positions of the conductors 11 and 21 in the X direction. Here, $L/\lambda_\varepsilon$ was set to the value where the isolation improved most in the simulations shown in FIGS. 4A to 4C. Other conditions were the same as in the simulations described above.

Figure 8A:
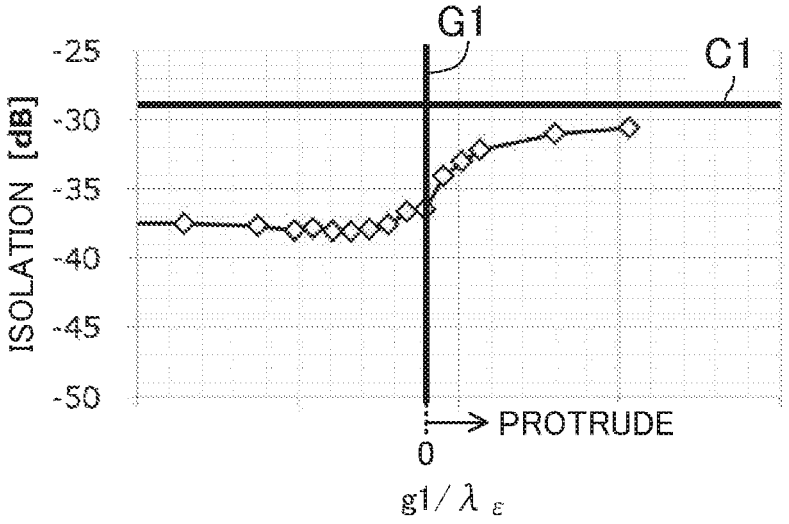
FIGS. 8A to 8C show graphs showing results of simulations using the configuration shown in FIG. 7.
Figure 8B:
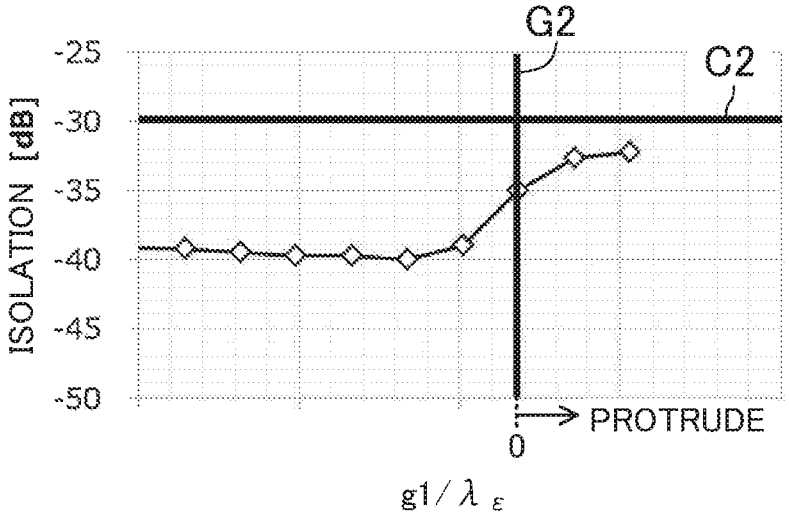
Figure 8C:
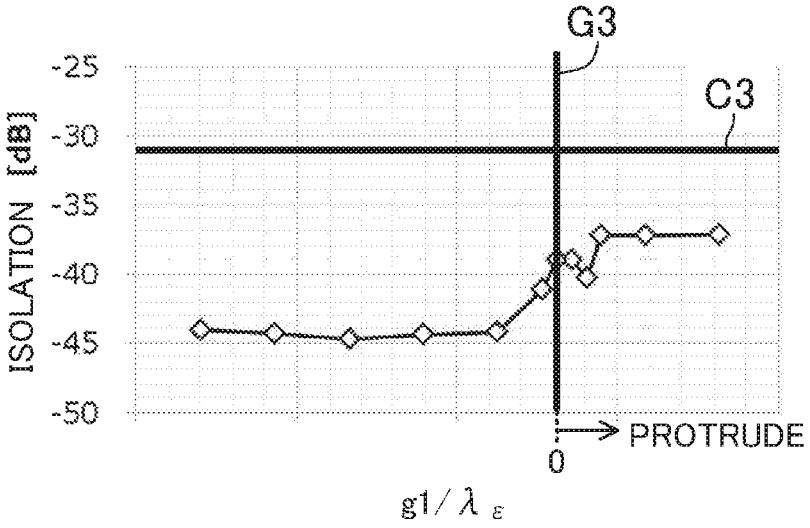

FIGS. 8A to 8C provide graphs showing simulation results; that is, FIGS. 8A to 8C respectively show the cases where the transmission frequencies are 20 GHz, 60 GHz, and 80 GHz. In each graph, the horizontal axis represents the value $g1/\lambda_\varepsilon$, and the vertical axis represents isolation (dB). The straight vertical lines G1 to G3 show the case where g1=0; that is, the ends of the conductor 21 and conductor 11 are in the same position in the X direction. The right sides of the vertical straight lines G1 to G3 show the ranges in which the conductor 21 protrudes more than the conductor 11 toward the first antenna element 2. The straight horizontal lines C1 to C3 indicate the isolation values where no isolation structure is provided.

As can be seen from FIGS. 8A to 8C, if the conductor 21 protrudes more than the conductor 11 toward the first antenna element 2, the effect of improving the isolation decreases at any transmission frequency. In other words, if the protrusion of the conductor 21 toward the first antenna element 2 is shorter than that of the conductor 11, the effect of improving the isolation by optimizing $L/\lambda_\varepsilon$ is maintained.

Pitch of Via Conductors

The present inventor performed simulations on the relationship between the pitch of the via conductors and the effect of improving the isolation. The transmission frequency was 60 GHz. The dielectric constant of the dielectric substrate was $\varepsilon_r$=3.0. $L/\lambda_\varepsilon$ was set to the value where the isolation improved most in the simulations described above. Other conditions were the same as the conditions in the simulations described above.

Figure 9A:
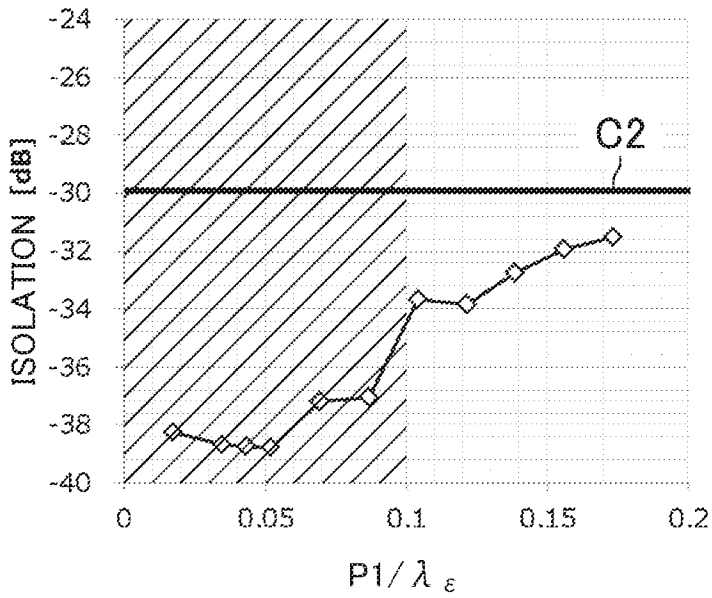
FIGS. 9A and 9B show graphs showing results of simulations where the pitch of via conductors is changed.
Figure 9B:
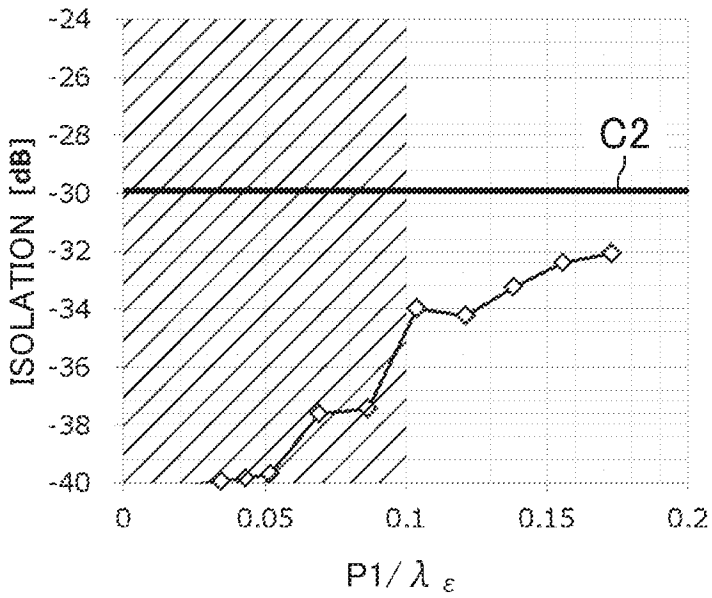
Figure 10:
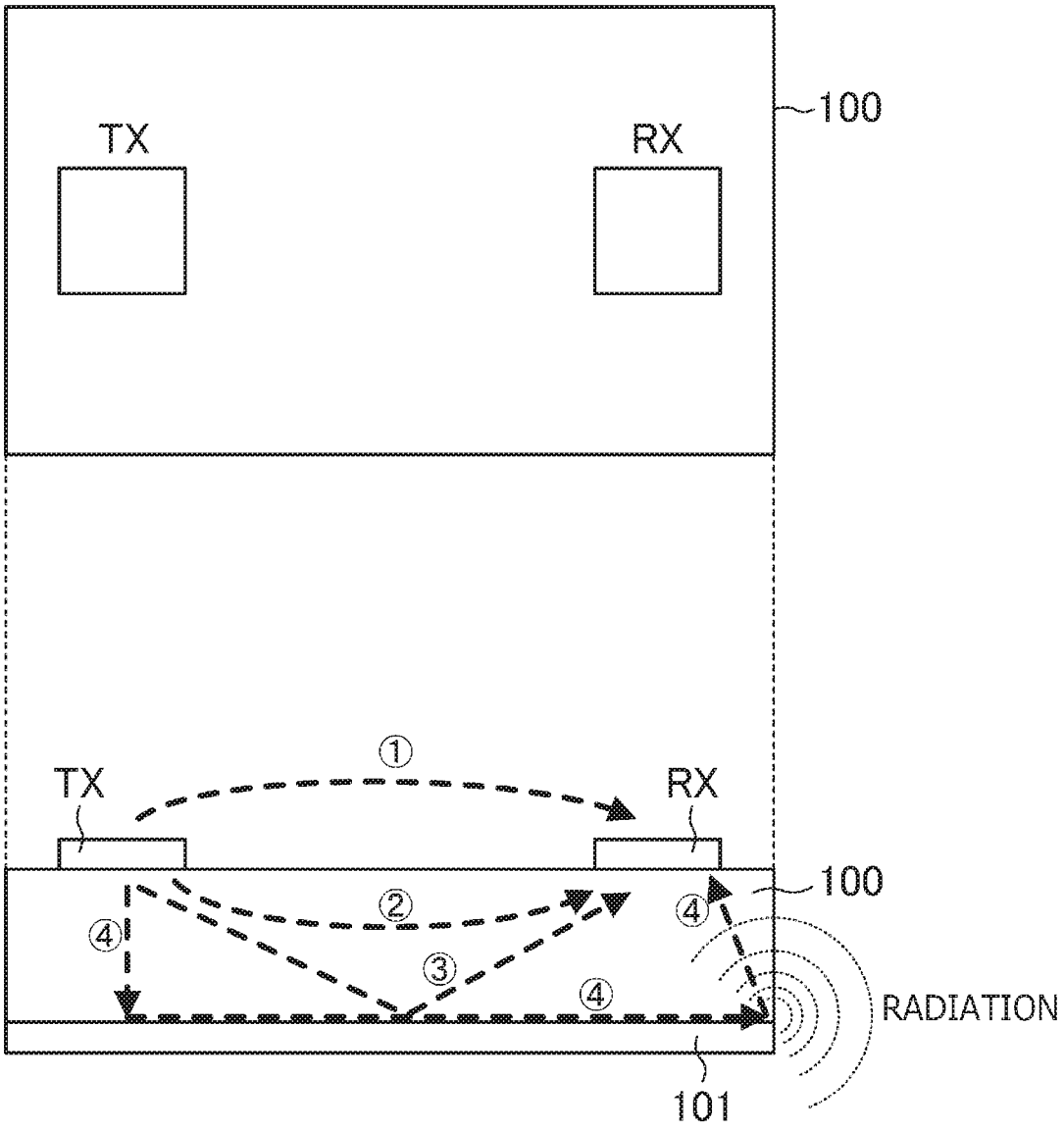
FIG. 10 is an explanatory diagram of isolation between antennas.

FIGS. 9A and 9B provide graphs showing simulation results; that is, FIG. 9A relates to the configuration of FIG. 3, whereas FIG. 9B relates to the configuration of FIG. 5. In each graph, the horizontal axis represents the value $p1/\lambda_\varepsilon$, and the vertical axis represents isolation (dB). The straight horizontal line C2 indicates the isolation value where the isolation structure 10 or 20 is not provided.

As can be seen from FIGS. 9A and 9B, if the value $p1/\lambda_\varepsilon$ is 0.1 or lower, the isolation structures 10 and 20 provide a sufficient effect of improving the isolation. That is, it can be said that the pitch p1 of the via conductors 12 and 22 in the Y direction may be equal to or less than 0.1 times the wavelength $\lambda_\varepsilon$ ($=\lambda 1/\sqrt{\varepsilon_r}$) of the radio waves propagating through the dielectric substrates 1 and 6.

The present disclosure increases the effect of improving isolation using an isolation structure, and is thus useful for improving the performance of an antenna device, for example.

What is claimed is:

1. An antenna device comprising:

a first dielectric substrate having a first surface and a second surface;

a first antenna element and a second antenna element on the first surface of the first dielectric substrate;

a ground conductor on the second surface of the first dielectric substrate; and an isolation structure between the first and second antenna elements, wherein the isolation structure includes:

a first conductor between the first and second antenna elements on the first surface of the first dielectric substrate; and a plurality of first via conductors that penetrate the first dielectric substrate and electrically connect the first conductor to the ground conductor, the first dielectric substrate has a dielectric constant of $\varepsilon_r$, the first antenna element is a transmitting antenna for transmitting a signal with a wavelength $\lambda 1$ (mm), in a plan view, the plurality of first via conductors are arranged at a predetermined pitch in a second direction perpendicular to a first direction in which the first and second antenna elements are arranged, and each of the first via conductors has a height h1 (mm), the first conductor protrudes with a length d1 (mm) from centers of the first via conductors toward the first antenna element in the first direction, and a value of $(d1\times 2+h1)/(\lambda 1/\sqrt{\varepsilon_r})$ falls within a range from 0.40 to 0.60.

2. The antenna device of claim 1, further comprising:

a second dielectric substrate having a first surface and a second surface, the second surface of the second dielectric substrate being in contact with the first surface of the first dielectric substrate, wherein the isolation structure further includes:

a second conductor on the first surface of the second dielectric substrate; and a plurality of second via conductors that penetrate the second dielectric substrate and electrically connect the second conductor to the first conductor.

3. The antenna device of claim 2, wherein in the plan view, from centers of the first via conductors toward the first antenna element in the first direction, protrusion of the second conductor has a same length as that of the first conductor.

4. The antenna device of claim 2, wherein in the plan view, the plurality of second via conductors are arranged at a predetermined pitch in the second direction, and in different positions from the first via conductors in the first direction.

5. The antenna device of claim 4, wherein in the plan view, from centers of the first via conductors toward the first antenna element in the first direction, protrusion of the second conductor is shorter than that of the first conductor.

6. The antenna device of claim 1, wherein the predetermined pitch at which the first via conductors are arranged in the second direction is equal to or less than 0.1 times $\lambda 1/\sqrt{\varepsilon_r}$.

* * * * *